US006527619B1

(12) United States Patent
Agostini et al.

(10) Patent No.: US 6,527,619 B1
(45) Date of Patent: Mar. 4, 2003

(54) PROJECTILE FIRING TOY VEHICLE

(75) Inventors: Matthew F. Agostini, Philadelphia, PA (US); Mary Ellen G. Fosbenner, Riverton, NJ (US); William F. M. Dougherty, Oakford, PA (US); Jeremy S. Robotham, Mt. Laurel, NJ (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/143,387

(22) Filed: May 10, 2002

Related U.S. Application Data

(60) Provisional application No. 60/339,876, filed on Oct. 31, 2001.

(51) Int. Cl.[7] ..... A63H 17/00

(52) U.S. Cl. ..... 446/435; 446/438; 446/270

(58) Field of Search ..... 446/435, 438, 446/93, 94, 95, 96, 269, 431, 434

(56) References Cited

U.S. PATENT DOCUMENTS

| | | | | |
|---|---|---|---|---|
| 1,282,549 | A | * | 10/1918 | Dittrick |
| 1,289,621 | A | * | 12/1918 | Blackshear |
| 2,279,386 | A | | 4/1942 | Carver |
| 2,551,109 | A | * | 5/1951 | Fornary |
| 2,652,822 | A | * | 9/1953 | Griffith |
| 3,065,569 | A | * | 11/1962 | Nielsen et al. |
| 3,264,782 | A | | 8/1966 | Glass et al. |
| 3,774,586 | A | * | 11/1973 | Saito |
| 3,869,825 | A | * | 3/1975 | Heberlein |
| 4,213,269 | A | * | 7/1980 | Grogg, Sr. |
| 4,435,916 | A | | 3/1984 | Iwao et al. |
| 4,659,320 | A | | 4/1987 | Rich et al. |
| 4,708,683 | A | * | 11/1987 | Lehmann et al. ..... 446/75 |
| 4,813,907 | A | * | 3/1989 | Rissman et al. ..... 446/175 |
| 5,125,668 | A | | 6/1992 | Welte |
| 5,335,917 | A | | 8/1994 | Kuna |
| 5,389,031 | A | | 2/1995 | Sharpe, III et al. |
| 5,759,083 | A | | 6/1998 | Polumbaum et al. |
| 5,766,056 | A | | 6/1998 | Tsai |
| 6,033,285 | A | * | 3/2000 | Fine et al. ..... 446/465 |
| 6,106,356 | A | | 8/2000 | Trageser |

* cited by examiner

*Primary Examiner*—Derris N. Banks
*Assistant Examiner*—Ali Abdelwahed
(74) *Attorney, Agent, or Firm*—Akin, Gump, Strauss, Hauer & Feld, L.L.P.

(57) ABSTRACT

A toy vehicle has a vehicle body, a firing apparatus rotatably mounted on the vehicle body and a ram mounted within the firing apparatus. A spring is operably coupled to the ram and a firing lever is rotatably coupled to the firing apparatus and the ram. Rotation of the firing lever retracts the ram against the spring and abruptly releases the ram to strike a projectile within the firing apparatus to fire the projectile from the firing apparatus. A pair of foot rests are pivotally mounted and releasably latched to the vehicle body and released by a button mounted on the rear of the vehicle body. The toy vehicle further includes circuitry having switches for operating light and/or sound effects on the toy vehicle.

11 Claims, 6 Drawing Sheets

10
40
40
141
142
24
111
112
44
105
32
144
117
116
166
151
115a
110
134
133
165
108
115
22
22
22
143
153
150d
120
132
42
150a
150c
103
140
121
122
150
113
113a
150b
104
114
152
109
170
142
128
38
154a
170a
142
129
167
162
30
154
126b
145
125
123
26
130
101
168
126a
138
134
101a
101b
139
131
172
146
163
147
137
19
137
167
157
149
156
106
155
139
102
107
18
158
148
164
164
161
137
18
137
160
161
139
19
138
162
36
137
139

PROJECTILE FIRING TOY VEHICLE

CROSS-REFERENCE TO RELATED APPLICATIONS

This application claims the benefit of U.S. Provisional Patent Application No. 60/339,876 filed Oct. 31, 2001, which is hereby incorporated by reference.

BACKGROUND OF THE INVENTION

The present invention relates to toy vehicles, and more particularly to a toy vehicle having a projectile firing apparatus.

A variety of toy vehicles which shoot or launch projectiles of various types are known in the prior art. Toy manufacturers consistently seek to add innovative new features to such toy vehicles to make them more versatile and/or entertaining. By way of example, some toy vehicles include a solenoid as a firing apparatus to shoot ping pong balls upon electrical actuation. Other toy vehicles include disk launching apparatus to launch disks onto a supporting surface. Many of these toy vehicles include complex electromechanical firing apparatus which are difficult and/or costly to manufacture.

BRIEF SUMMARY OF THE INVENTION

According to one aspect of the invention, a toy vehicle is provided having a vehicle body, a projectile firing apparatus rotatably mounted on the vehicle body and a ram mounted within the firing apparatus. A spring is operably coupled to the ram. A firing lever is rotatably coupled to the firing apparatus and the ram such that rotation of the firing lever about an axis of rotation first retracts the ram against the spring and then abruptly releases the ram to strike a projectile within the firing apparatus to fire the projectile from the firing apparatus.

In another aspect, the invention is a toy vehicle that comprises a vehicle body; a projectile firing apparatus on the vehicle body; a handle operably connected to the firing apparatus to manually fire projectiles from the firing apparatus; and a pair of foot rests pivotally mounted and releasably latched to the vehicle body.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
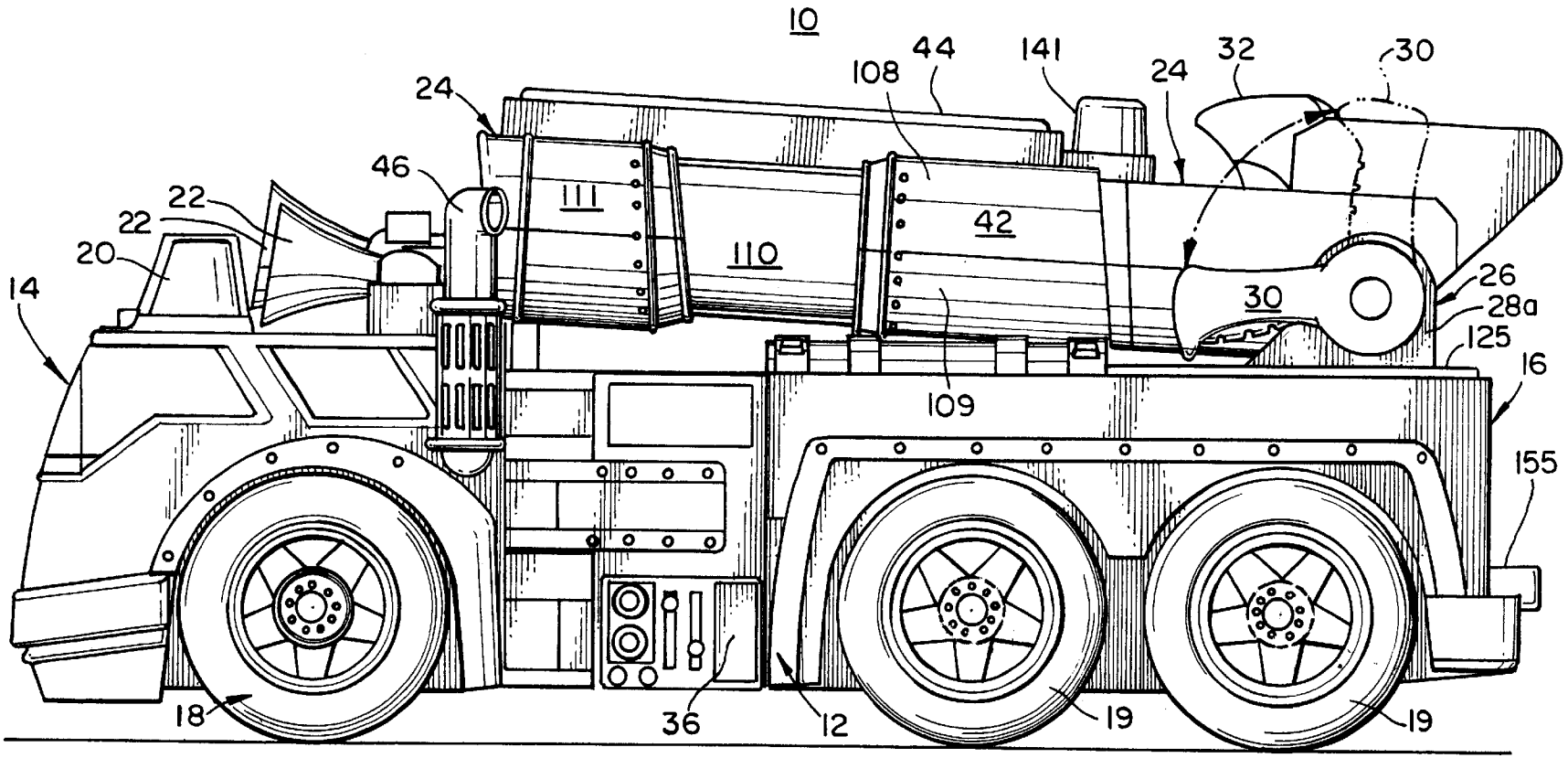
FIG. 1 is a first side elevation of one embodiment of a toy vehicle according to the present invention.
Figure 2:
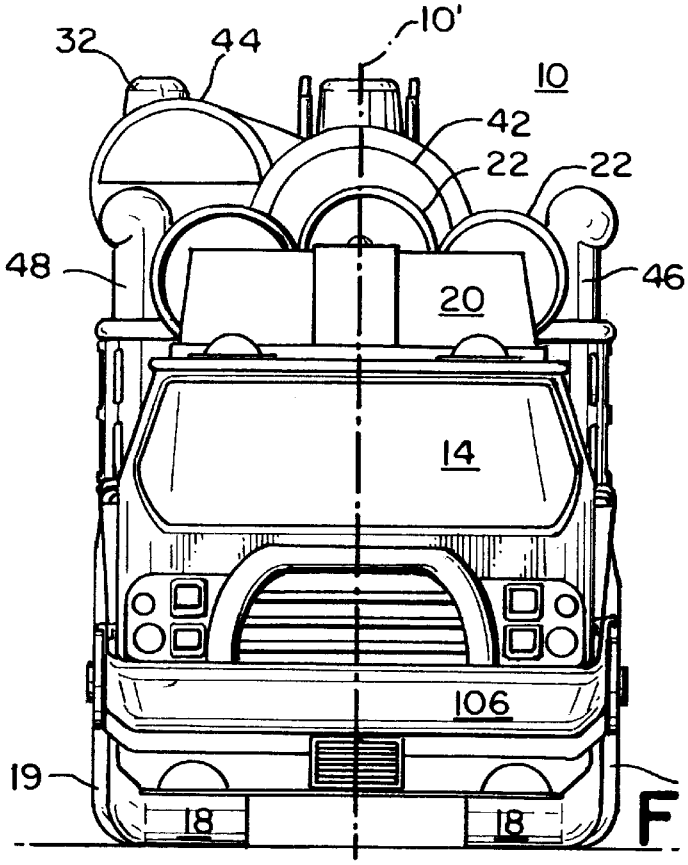
FIG. 2 is a front elevation of the embodiment of FIG. 1.
Figure 4:
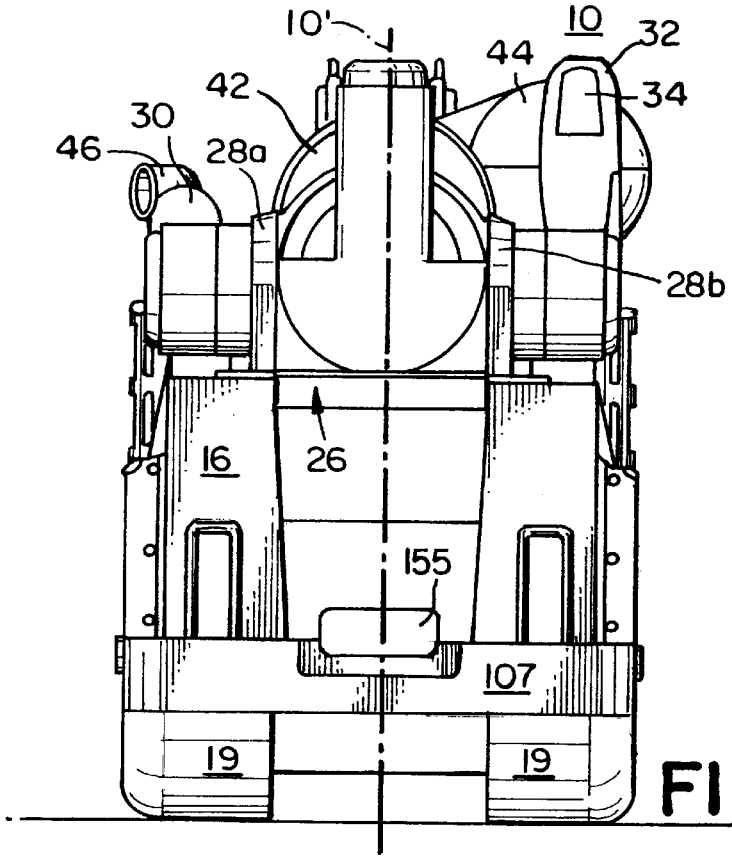
FIG. 4 is a rear elevation of the embodiment of FIGS. 1–3.
Figure 3:
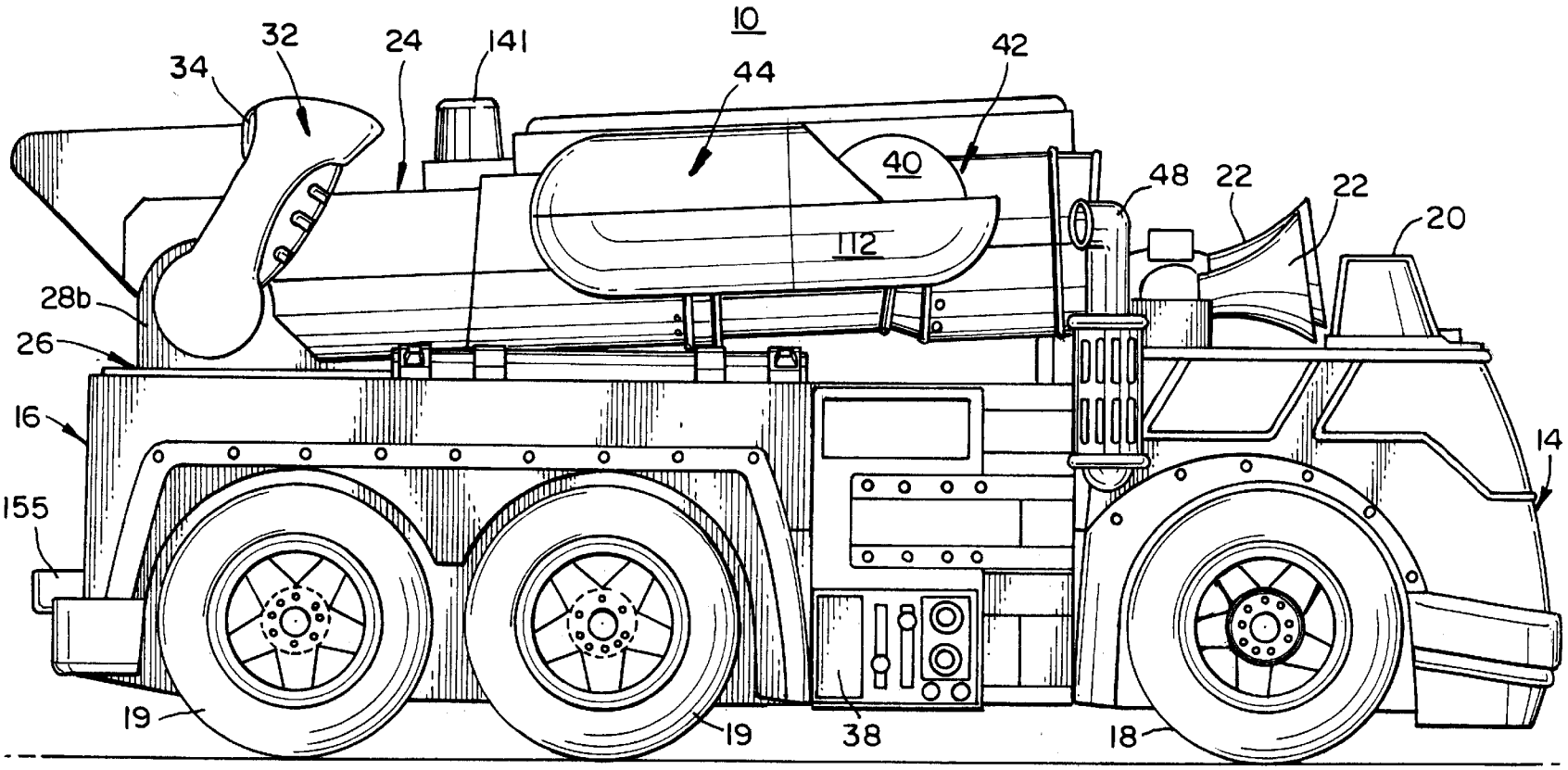
FIG. 3 is an opposing side elevation of the embodiment of FIGS. 1 and 2.
Figure 5:
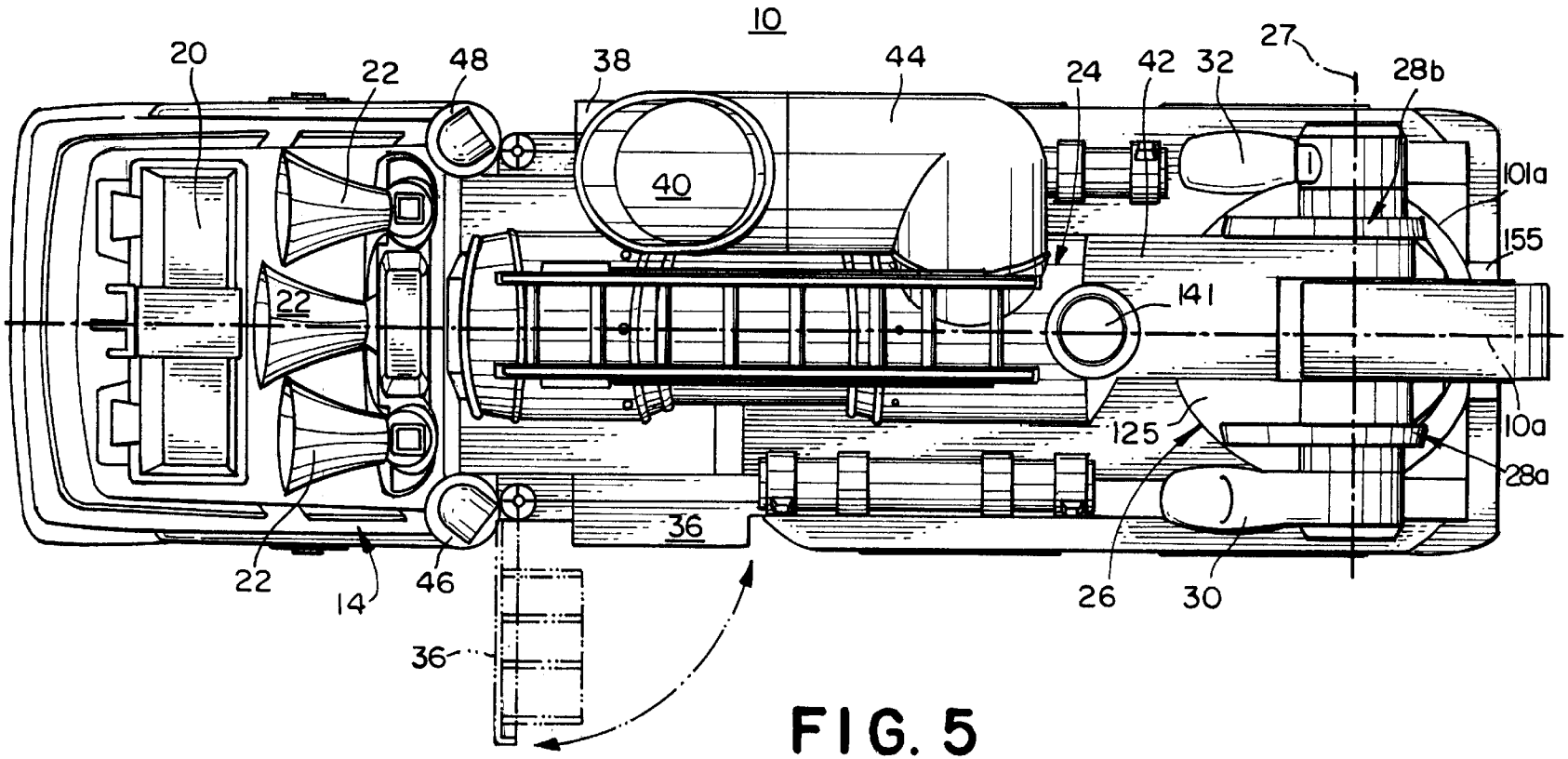
FIG. 5 is a top plan view of the embodiment of FIGS. 1–4.
Figure 5A:
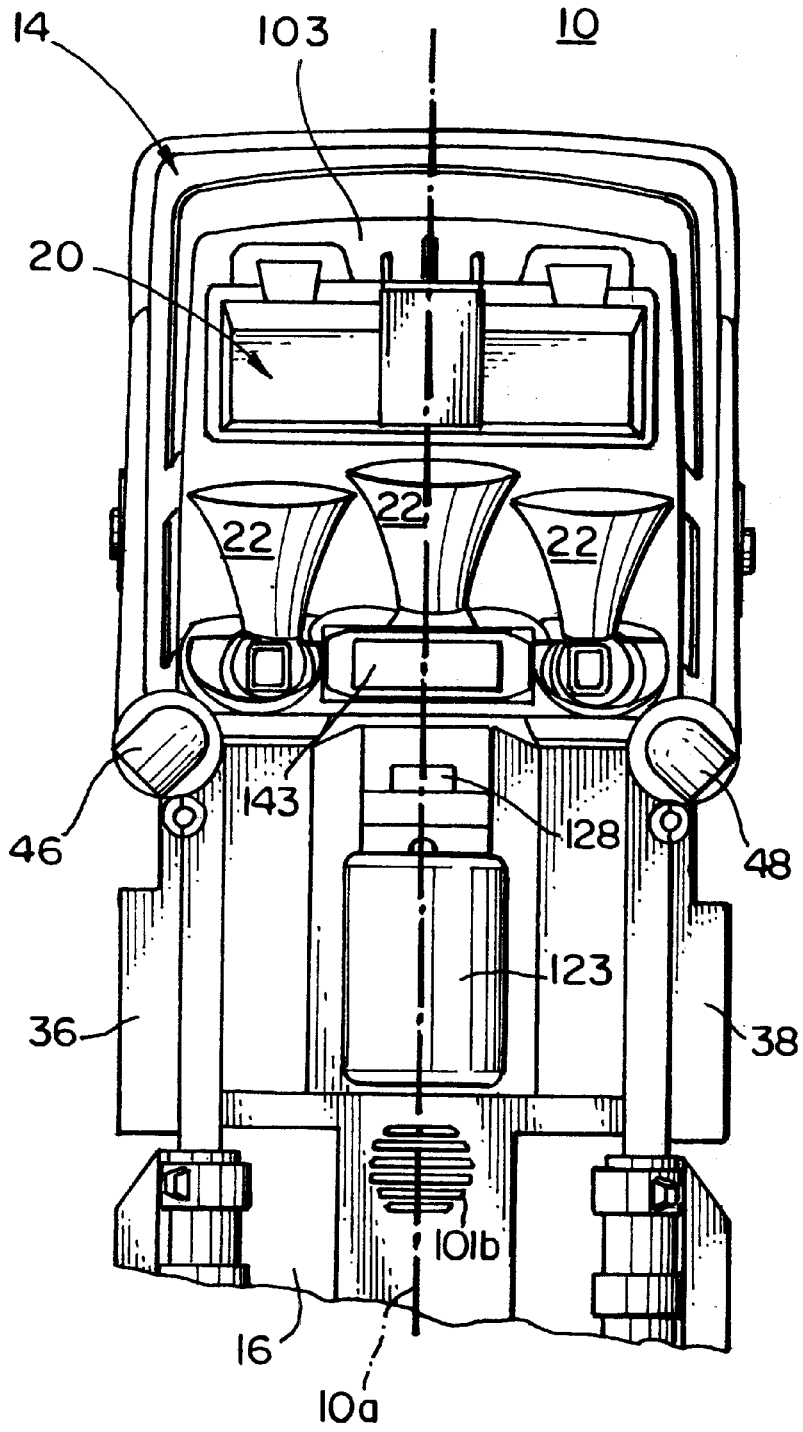
FIG. 5*a* is a partial top plan view of the front of the embodiment of FIG. 5 with the water cannon removed.

The toy vehicle of the present invention is described herein with reference to an embodiment in the form of a fire truck. It will be appreciated by those skilled in the art that various other embodiments in the form of known vehicles such as automobiles, dump trucks, tanks and the like, can include the broad inventive concepts as defined by the appended claims.

Referring to FIGS. 1–6 an embodiment of the toy vehicle of the present invention, in the form of a fire truck, is shown and indicated generally at 10. The vehicle 10 is configured with a body 12 constituting a cab 14 in front of a deck 16. Front and rear wheels 18 and 19, respectively, rollingly support the body 12. The cab 14 may include a light bar 20, and a plurality of "horns" 22 mounted on a top portion thereof. A firing apparatus or, as in the present embodiment, a "water" cannon indicated generally at 24, is mounted on a top portion of the deck 16. The cannon 24 includes a main firing tube 42. The rear end of the cannon 24 is mounted to a turret 26 located on an upper rear portion of the deck 16. The turret 26 preferably comprises a turntable 125 which enables the cannon 24 to be pivoted laterally to either side of a central vertical plane 10' which contains a longitudinal center line 10*a* of the vehicle 10. The rear end of the cannon 24 is preferably pivotably mounted to the turret 26 to pivot about a horizontal axis 27 (shown in FIG. 5) which extends between a pair of spaced apart arms 28*a,* 28*b* that project upwardly from the deck 16 as part of the turret 26.

Projecting outwardly and forwardly from approximately the middle of the right side of the firing tube 42 is a feed tube 44. The cannon 24 fires projectiles such as balls 40 or the like. The balls 40 are preferably blow molded polyethylene for shape integrity and safety, one of which is seen in the mouth of the feed tube 44. The feed tube 44 preferably can store a plurality (e.g., three) of the balls 40. It will be understood that the feed tube can be of various sizes and shapes to hold various types of projectiles for firing from the cannon 24 and is therefore not limited to the particular configuration shown. Alternatively, the feed tube 44 can be eliminated and projectiles can be loaded directly into the cannon 24 through an opening at the end or in a middle portion of the cannon 24.

A first or "left" handle 30 is preferably rotatably coupled to the left side of the turret 26 and the cannon 24. A second or "right" handle 32 is preferably fixedly coupled to the right side of the cannon 24 and is mechanically coupled to the turret 26 in the right arm 28*b*. The right handle 32 preferably includes a sound effect controlling activation button or switch 34. It will be understood that the left and right handles 30, 32 may be coupled to the turret 26 and the cannon 24 on either the left or right side, and that the switch 34 may be positioned on the left or right handles 30, 32 in any position.

Figure 6:
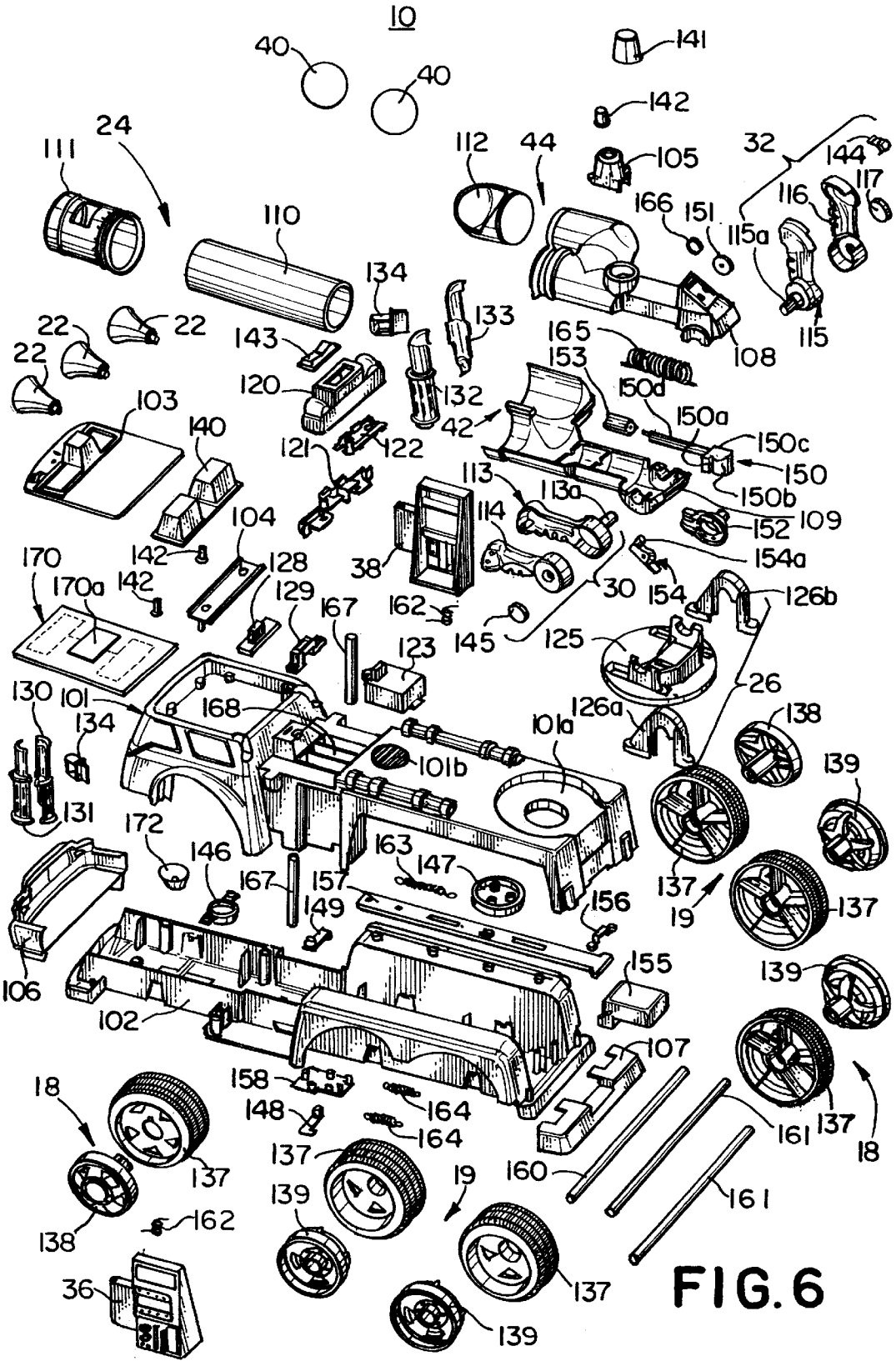
FIG. 6 is an exploded view of the embodiment of FIGS. 1–5.

Referring now to FIG. 6, where the vehicle 10 is shown in exploded form, the body 12 is preferably formed primarily by a body shell 101 mounted on a chassis 102. Front and rear bumpers 106 and 107 are preferably mounted to the chassis 102. A cab roof 103 may be included to cover the cab 14 and a truck light support member 104. The truck light support member 104 preferably couples with a light bar housing 140 inside the cab. The support member 104 supports a pair of light bulbs 142 and secures the housing 140 to the roof 103. A horn housing top 120 and bottom 121 may be mounted to the cab roof 103, between which the individual horns 22 are preferably captured. A rocker switch 143 and a rocker switch retainer 122 are preferably mounted in the horn housing top 120.

The vehicle 10 may also include left and right exhaust members 46, 48 mounted to the left and right sides of the body shell 101. The left and right exhaust members 46, 48 are preferably formed by half shells 130/131 and 132/133, respectively. Each pair of exhaust half shells may be coupled to the rear corners of the cab 14 on the body shell 101 by a support 134.

A plurality of battery holding slots 168 are preferably provided in the body shell 101 behind the cab 14. The batteries are retained by a battery door 123. An on/off switch 128 may be mounted to the body shell 101 in front of the battery door 123 by means of a retainer bracket 129.

The vehicle 10 preferably also includes front wheels 18 formed by tires 137 which receive hubs 138. The hubs 138 are mounted to the ends of a front shaft 160, which is trapped in the chassis 102. Rear wheels 19 are similarly provided and preferably include the same tires 137 with slightly modified hubs 139. Each of the two pairs of rear wheels 19 is preferably mounted to opposing ends of a separate rear wheel shaft 161, which extends through openings in the rear portion of the chassis 102.

Left and right foot rests (i.e. outriggers or pedals ) 36, 38 are preferably pivotally mounted to the body shell 101 with vertical shafts 167. Each foot rest 36, 38 is preferably spring loaded to open by means of torsion coil springs 162. Each of the foot rests 36, 38 is preferably releasably latched against a side wall of the body shell 101 and held in place by lock members 148 and 149. The lock members 148 and 149 are preferably pivotally mounted to a foot rest lock support 158 attached to the chassis 102. Lock members 148, 149 are drawn into latched positions holding the foot rests 36, 38 against the sides of the body shell 101 by tension springs 164. The foot rests 36, 38 are preferably released by means of a lever 157, which extends within the chassis 102 from the lock support 158 to a button 155 exposed at the rear of the vehicle 10. The button is preferably pivotally mounted to cam the lever 157 forward when the button 155 is depressed. A spring 163 may be provided to bias the lever 157 rearward, camming the button 155 to a raised position when not being used. The lever 157 may be at least partially secured in place by means of a U-shaped retainer 156. It will be understood that various means know in the art may be used to pivotally mount the foot rests 36, 38 to the vehicle body and to releasably latch the foot rests 36, 38 against the sides of the body shell 101.

In a preferred embodiment, the cannon 24 is preferably formed by upper and lower cannon half shells 108 and 109. The forward portion of the firing tube 42 preferably comprises a smooth tube 110 captured between the cannon half shells 108, 109, and a muzzle 111. The forward end of the feed tube 44 comprises a hollow guide 112, captured between the cannon half shells 108, 109. A light support 105 supporting a light bulb 142 and a cover 141 is preferably mounted to the top of the upper cannon half shell 108. It will be understood that the cannon 24 can alternatively be formed as a single molded tube, with or without the a feed tube 44 extending therefrom and with or without the light support 105.

Operably positioned between the cannon half shells 108, 109 are a ram 150, comprising a forward extending shaft 150*d*, and a compression coil spring 165. A ram cover 153 may be included at the forward end of the shaft to capture the compression coil spring 165.

The ram 150 is preferably operated by the left handle 30. In a preferred embodiment an actuator or firing lever 154 a proximal end of which is attached to the distal end of shaft 113*a* of the handle 30 by a lever lock plate 152 away from the shaft 113*a* and the axis of rotation of the lever. The actuator lever 154 includes a pin 154*a* at a distal end which projects outwardly from the lock plate 152. The actuator lever 154 preferably includes a spring (not shown) biasing the pin 154*a* outward from the lock plate 152 and into engagement with a combined cam/keeper 150*c* integrally formed at the rear end of the ram 150. The cam/keeper 150*c* includes a vertical slot 150*a* which receives the pin 154*a* of the acutator lever 154, and a sloping cam surface 150*b*, which extends rearwardly from the vertical slot 150*a*.

When the left handle 30 is in a down position (seen in solid in FIGS. 1, 4 and 5), the pin 154*a* of the actuator lever 154 is received in the vertical slot 150*a*. As the left handle 30 is rotated (as depicted in phantom in FIG. 1), the pin 154*a* rides upwardly in the vertical slot 150*a*, and, at the same time retracts the ram 150 against the compression coil spring 165. At a point in the rotation of the handle 30 (preferably about 110 degrees), the pin 154*a* exits the top end of the vertical slot 150*a*, suddenly releasing the ram 150 to return to an original, extended position, striking any ball 40 which may be present in front of the ram 150, and firing the ball 40 out of the cannon 24. A torsional spring 166 is preferably included to bias the handle 30 to return to the down position (9 o'clock in FIG. 1). As the handle 30 returns to the down position, the pin 154*a* rides up the sloping cam surface 150*b*, which biases the pin 154*a* into the lock plate 152 until the pin 154*a* aligns with the vertical slot 150*a* and is biased outward from the lock plate 152 into the vertical slot 150*a*.

The turret 26 preferably comprises a main turntable 125 mounted for rotation in a circular well 101*a* at a back portion of the body shell 101 in what is the upper rear side of the deck 16. The turret 26 is preferably secured to the body shell 101 by means of a retainer 147 inside the shell. Arms 28*a* and 28*b* are preferably formed, in part, by half journals on the turntable 125 and, in part, by "U" shaped retainers 126*a*, 126*b* mounted to the turntable 125. The "U" shaped retainers 126*a*, 126*b* are secured over the shafts 113*a*, 115*a* extending from the left and right handles 30 and 32, respectively. As can be seen in the exploded view of the preferred embodiment, the left handle 30 can include a cover 145, an outer half shell 114, an inner half shell 113 with a shaft 113*a* that extends under left retainer 126*a* and between the cannon half shells 108, 109.

The right handle 32 preferably includes a cover 117, outer half shell 116 and an inner half shell 115 having a shaft 11 5a extending beneath retainer 126*b* and between the cannon half shells 108 and 109. The shaft 115*a* preferably includes a protruding key along part of its length which couples handle 32 to cannon 24 for rotation of the cannon 24 about axis 27. Finally, a disk 151 is attached to an innermost end of shaft 115*a* to capture the right handle 32 in the cannon 24. A switch 34, preferably a momentary contact touch switch, is mounted within the left or right handles 30, 32 and a handle switch cover 144 is movably captured between the handle half shells. The switch 34 is preferably coupled to a microprocessor 170*a* for sound effect generation.

A circuit board 170 preferably including the microprocessor 170*a* with a sound effects generator and memory is mounted to the vehicle 10, preferably between the body shell 101 and the chassis 102. The microprocessor 170*a* is preferably designed to control activation of the light bulbs 142 and sound effect generation. Preferably, at least one speaker 172 is operably coupled to the microprocessor 170*a* and mounted to the vehicle 10, preferably beneath a grill 101*b* in the body shell 101 by a retainer 146.

Light and/or sound effects are preferably generated automatically by the microprocessor 170*a* in response to turning the vehicle on and/or in response to switch activations by the user (e.g., rocker switch 143, handle switch 34). Switches can also be provided in the vehicle 10 to be activated by operation of the action features of the vehicle 10, for example, rotation of the left handle 30 to fire the cannon 24 or deployment of the foot rests 36, 38.

The vehicle 10 can be operated in a conventional fashion utilizing the rocker switch 143 on the cab roof 103 to generate sound and light effects (e.g., left side for sirens, right side for air horns). The microprocessor 170*a* may also be programmed to cause the various lights 142 to be flashed in response to the depression of either side of the rocker switch 143. The switch 34 and the switch cover 144 in the right handle 32 can also be used to generate sound effects (e.g., hydraulic motor/pump sounds prior to firing cannon).

By pressing the button 155 at the rear of the vehicle 10, the left and right foot rests 36, 38 are released from a latched position. Torsion coil springs 162 force the left and right foot rests 36, 38 to rotate outward (preferably about ninety degrees) so that a child straddling the vehicle 10 from behind can place his/her feet against the foot rests 36, 38.

The cannon 24 can be rotated to the left and to the right of the longitudinal center line 10*a* of the vehicle 10 on the turntable 125 and pivoted upward on shafts 113*a*, 115*a* to elevate the cannon 24. Preferably, the left handle 30 is rotatably attached to the turret 26 and cannon 24 to rotate with respect to each and operatively coupled with the ram 150 inside the cannon 24. Each time the left handle 30 is rotated from the down position, shown in solid in FIGS. 1, 4 and 5, to the up position, shown in phantom in FIG. 1, the ram 150 is withdrawn and cocked, a ball 40 is permitted to drop from the feed tube 44 into the firing tube 42 and the ram 150 is released (at a point in the rotation of the left handle 30). An internal switch (not depicted) can be operatively coupled with the left handle 30 and/or the ram 150 to send a signal to the microprocessor 170*a* when the ram 150 is being released or ready to release, causing the microprocessor 170*a* to generate a water blast sound effect or the like simultaneous with the launching of the ball 40. The water blast sound effect preferably interrupts and overrides any other sound effects which may have been sounding at the time the ball 40 is launched. The left handle or ram switch can comprise multiple switches which trigger light and/or sound effects when the handle 30 is first rotated or when the ram 150 is retracted. A water blast sound effect can be subsequently triggered when the handle 30 is further rotated and/or when the ram 150 is released.

Preferably the toy vehicle 10 is also configured for a "try me" mode while still packaged for sale. The left handle 30 can be exposed to rotate in the package and can be used to activate light and sound effects, as well as to cock and release the firing mechanism. By blocking the front end of the firing tube 42 while the vehicle 10 is in the package, one of the balls 40 in the firing tube can actually be fired forward in the package (without leaving the firing tube 42) and the firing sound effect activated. The light and sound effects can be programmed to be generated for only a short period of time (e.g., six seconds), unless reinitiated, to conserve battery power.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A toy vehicle comprising:

a vehicle body;

a projectile firing apparatus rotatably mounted on the vehicle body;

a ram mounted within the firing apparatus;

a spring operably coupled to the ram;

a firing lever rotatably coupled to the firing apparatus and the ram such that rotation of the firing lever about an axis first retracts the ram against the spring and then abruptly releases the ram to strike a projectile within the firing apparatus to fire the projectile from the firing apparatus.

2. A toy vehicle comprising:

a vehicle body;

a projectile firing apparatus rotatably mounted on the vehicle body, the firing apparatus including a firing tube receiving a projectile;

a ram mounted within the firing apparatus;

a spring operably coupled to the ram;

a firing lever rotatably coupled to the firing apparatus and the ram such that rotation of the firing lever about an axis first retracts the ram against the spring and then abruptly releases the ram to strike the projectile within the firing tube to fire the projectile from the firing tube;

a turret rotatably mounting the firing apparatus on the vehicle body and pivotally supporting the firing tube;

a first handle rotatably coupled at least with the firing apparatus and operably coupled to the firing lever.

3. The toy vehicle according to claim 2 further comprising a pin coupled with the firing lever away from the axis and a keeper coupled with the ram, the keeper having a surface feature engaged by the pin to withdraw the ram during rotation of the firing lever until the lever reaches a point of release of the pin from the keeper.

4. The toy vehicle according to claim 2 further comprising a pair of foot rests pivotally mounted and releasably latched to opposite lateral sides of the vehicle body.

5. The toy vehicle according to claim 4 further comprising a button mounted on a rear portion of the vehicle body and operably coupled with the pair of foot rests to release the foot rests to pivot outwardly from the vehicle body.

6. The toy vehicle according to claim 2 further comprising circuitry including one or more switches for operating one or more light and/or sound effects.

7. The toy vehicle according to claim 2 further comprising a second handle fixedly coupled to the firing tube and rotatably coupled to the turret such that the firing tube is pivoted with the second handle.

8. A toy vehicle comprising:

a vehicle body;

a projectile firing apparatus on the vehicle body;

a handle operatively connected to the firing apparatus to manually fire projectiles from the firing apparatus; and a pair of foot rests pivotally mounted and releasably latched to the vehicle body.

9. A toy vehicle according to claim 8 further comprising a button mounted on a rear portion of the vehicle body operatively coupled with the pair of foot rests to release the foot rests to pivot outwardly from the vehicle body.

10. A toy vehicle according to claim 8, further comprising circuitry including one or more switches for operating one or more light and/or sound effects.

11. A toy vehicle comprising:

a vehicle body;

a projectile firing apparatus rotatably mounted on the vehicle body;

a ram mounted within the firing apparatus;

a combined cam/keeper fixedly attached to the ram;

a spring operably coupled to the ram;

a handle rotatably connected with the firing apparatus;

a firing lever engaged to rotate with the handle and rotatably coupled to the ram, wherein the ram has a first uncocked position corresponding to a first position of the handle and the lever and a second cocked position corresponding to a second position of the handle and the lever;

a pin fixedly attached to the firing lever, the pin being in sliding engagement with a slot in the combined cam/keeper, such that as the handle is rotated from the first position of the handle to a position beyond the second position of the handle, the pin is released from the slot and the ram moves from the second cocked position to the first uncocked position under the action of the spring and fires a projectile from the firing apparatus and, as the handle is returned to the first position of the handle, the pin moves along a cammed surface of the combined cam/keeper until the pin re-engages the slot.

* * * * *